US006598803B1

(12) United States Patent
Haas et al.

(10) Patent No.: US 6,598,803 B1
(45) Date of Patent: Jul. 29, 2003

(54) POWDER SPRAY COATING DEVICE

(75) Inventors: Gerald Haas, St. Gallen (CH); Felix Mauchle, Abtwil (CH); Hans Peter Michael, St. Gallen (CH)

(73) Assignee: ITW Gema AG, St. Gallen (CH)

( * ) Notice: Subject to any disclaimer, the term of this patent is extended or adjusted under 35 U.S.C. 154(b) by 0 days.

(21) Appl. No.: 09/763,351

(22) PCT Filed: Jun. 9, 1999

(86) PCT No.: PCT/EP99/03967

§ 371 (c)(1),
(2), (4) Date: Apr. 13, 2001

(87) PCT Pub. No.: WO00/10726

PCT Pub. Date: Mar. 2, 2000

(30) Foreign Application Priority Data

Aug. 22, 1998 (DE) ..... 198 38 276

(51) Int. Cl.[7] ..... B67D 5/08; B05B 7/12

(52) U.S. Cl. ..... 239/67; 239/69; 239/71; 239/407; 239/408; 239/412; 239/419

(58) Field of Search ..... 239/67, 69, 71, 239/407, 408, 410, 411, 412, 413, 419; 406/14, 19, 31, 30, 152

(56) References Cited

U.S. PATENT DOCUMENTS

| | | | | | |
|---|---|---|---|---|---|
| 4,743,143 | A | * | 5/1988 | Nagasaka | 406/14 |
| 4,747,731 | A | * | 5/1988 | Nagasaka et al. | 406/14 |
| 5,487,624 | A | * | 1/1996 | Toyota et al. | 406/14 |
| 5,615,980 | A | * | 4/1997 | Mauchle | 406/19 |
| 5,676,494 | A | * | 10/1997 | Ruch | 406/152 |
| 6,000,995 | A | * | 12/1999 | Ruholl | 406/31 |
| 6,176,647 | B1 | * | 1/2001 | Itoh | 406/31 |
| 6,382,521 | B1 | * | 5/2002 | Haas | 239/69 |

FOREIGN PATENT DOCUMENTS

| | | |
|---|---|---|
| EP | 0 636 420 A2 | 2/1995 |
| EP | 0 686 430 A2 | 12/1995 |

* cited by examiner

*Primary Examiner*—Robin O. Evans
(74) *Attorney, Agent, or Firm*—Lowe Hauptman Gilman & Berner, LLP

(57) ABSTRACT

A spray powder-coating apparatus fitted with an electronic control system (21) regulating the air flows (20, 43) to an injector (4) as a function of setpoints (m) for the rates of powder to be moved, and as a function of a setpoint (GV) for the total rate of air passing through the nozzle, by means of motor-driven adjustable throttles (18, 19, 44, 45), preferably also as a function of the actual values (89, 90) of the regulated air flows (20, 43).

6 Claims, 1 Drawing Sheet

POWDER SPRAY COATING DEVICE

Figure 1:
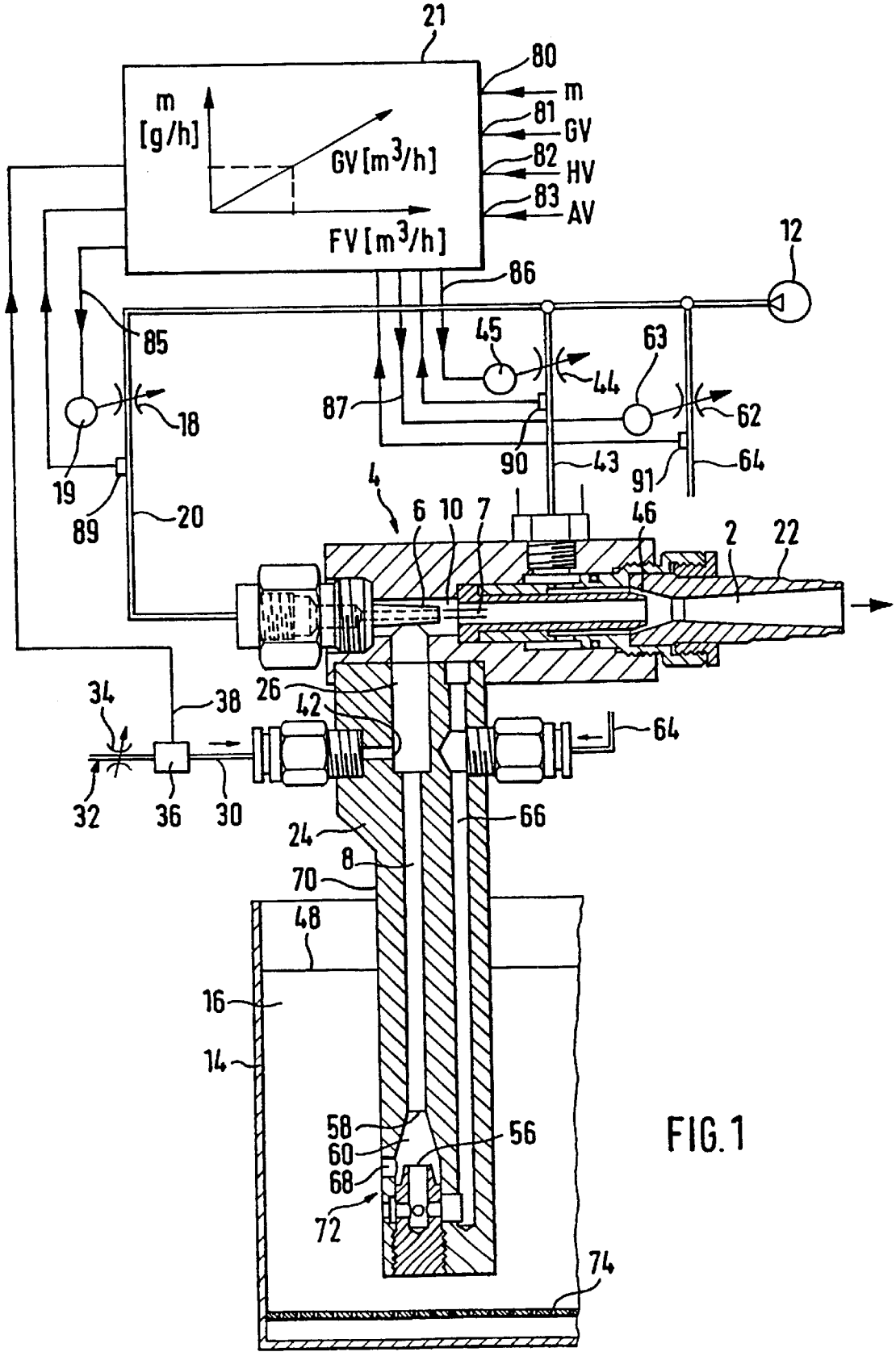

The invention relates to spray powder-coating apparatus defined in the preamble of claim 1.

Such a spray powder-coating apparatus is known from the European patent document 0 686 430 A.

The European patent document 0 636 420 discloses spray powder-coating apparatus fitted with an electronic regulating system generating setpoint signals for the required rate of powder, i.e. the quantity of powder per unit time, as a function of a setpoint value, and for the rate of total air to be conveyed, i.e. the quantity of total air per unit time, which is required to move the powder, said setpoints being applied to pressure regulators which then correspondingly regulate the feed of conveyance air and of supplemental air to an injector. The setpoint signals from the regulation system are construed as setpoint values by the regulators and are utilized in relation to the actual values of the conveyance air or of the supplemental air to regulate said conveyance or supplemental air. Volumetric regulators may also be used instead of the pressure regulators.

A pneumatic powder conveyance system is known from U.S. Pat. No. 4,747,731 (corresponding to the European patent documents 0 239 331 A and 0 423 850 A), which comprises 2 injectors of which the main injector is mounted at the downstream end and an auxiliary injector is mounted at the upstream end of a powder aspirating tube.

It is known from U.S. Pat. No. 5,186,388 to measure the partial vacuum in the partial-vacuum zone of an injector and to use this measurement as being the powder rate. It is known from U.S. Pat. No. 4,544,306 to use a measuring tube having one end open to the atmosphere and another open end opening into a powder/air duct to measure the pressure therein. Depending on the pressure relative to atmospheric generated by the powder/air flow, a valve shall be opened or closed at the powder feeding outlet situated at the lower funnel-shaped end of a powder supply cart.

Air dividers are known from U.S. Pat. No. 3,625,404 and from German patent document 44 09 493 A which contain a throttling valve in a conveyance air line and a throttling valve in a supplemental air line, said valves being mechanically coupled to each other. To the extent one of said valves shall close the other one shall open.

The objective of the present invention is to create accurate and stable regulation of the pneumatically conveyed flow of powder as a function of a manually or automatically preset setpoint value for the rate of applied powder, without thereby requiring expensive pressure regulators or volumetric controls.

This problem is solved by the invention by means of the features of claim 1.

The invention offers economical apparatus of simple design which enables automated and accurate regulation of a powder/air flow and allowing stable air flow of powder/air, free of pulsations, from start to shutdown.

The concepts of values such as "reference value, actual value, and/or setpoint value . . ." used in the present disclosure shall denote, depending on the desired design of the apparatus, the value at a point or of a range of values. However even as regards a value at a point, the tolerance-entailed fluctuations in value still shall be within the scope of the invention.

The invention is elucidated below in relation to a preferred, illustrative embodiment and to the attached drawing.

FIG. 1 shows spray powder-coating apparatus of the invention fitted with an injector shown in axial section and a powder aspirating tube shown in vertical section.

The spray powder-coating apparatus of the invention shown in FIG. 1 comprises a powder/air duct 2, a fluid-conveying injector 4 fitted with an injector nozzle 6 substantially pointing axially in the direction of the powder/air duct 2, and a powder aspirating duct 8 connected in a manner to set up a flow from a partial-vacuum chamber 10 of the injector 4. The partial-vacuum chamber 10 is situated between the injector nozzle 6 and the powder/air duct 2. A jet of conveyance air 7 issuing from a source of compressed air 12 and driven from the injector nozzle 6 into the powder/air duct 2 aspirates powder 16 from a powder container 14 through the powder aspirating duct 8 into the partial-vacuum chamber 10 wherein the powder mixes with the jet of conveyance air and then jointly with it flows through the powder/air duct 2. The source of compressed air 12 is connected by a compressed-air line 20 to allow flow to the injector nozzle 6. The compressed-air line 20 contains a variable throttle 18 of which the flow impedance (for instant the flow cross-section) is regulated from an electronic regulator 21 by means of an adjusting motor 19 operationally connected to it and as a function of a setpoint value of the volumetric flow of conveyance air and/or of a setpoint value for the rate of powder.

The downward end 22 of the powder/air duct 2 shown in FIG. 1 may be designed as an atomizing nozzle or it may be connected by a hose to powder sprayer for spraying an object to be coated.

The powder aspirating duct 8 runs through an immersion tube 24 vertically dipping into the powder 16 of the powder container 14. An upper end 26 of the powder aspirating duct 8 exhibits a flow cross-section which is wider than that of the upstream duct segment, said widened flow cross-section adjoining the partial-vacuum chamber together with which it constitutes a partial-vacuum zone 10 wherein the jet of conveyance air 7 of the injector nozzle 6 generates a substantially homogeneous partial vacuum. The partial vacuum generated by the jet of conveyance air 7 is effective, if at differing levels, throughout the entire powder aspirating duct. The partial-vacuum zone 10, 26 communicates, or may be connected in flow-enabling manner, through a measurement duct 30 with the atmosphere 32, said duct 30 being fitted with an adjustable flow throttle 34.

The partial vacuum existing in the partial-vacuum zone 10, 26 aspirates air from the atmosphere 32 while being strongly throttled by the flow throttle 34 when passing through the measurement duct 30. The measurement duct 30 is fitted with a measuring element 36 generating a measurement signal in the signal line 38 as a function of the air flowing from the atmosphere 32 through the measurement duct 30 into the partial-vacuum zone 10, 26, said signal being a measure of the flow, i.e. the quantity per unit time, or rate, of air passing through the measurement duct 30 and hence also being a measure of the rate of powder passing through the powder/air duct 2. The measurement signal may be electrical, pneumatic or hydraulic and correspondingly the signal line 38 operationally connected to the regulation system 21 also may be electrical, pneumatic or hydraulic. Preferably the downstream end 42 of the measurement duct 30 is connect in a manner allowing fluid flow to the partial-vacuum chamber 10. As regards the embodiment of FIG. 1, the downstream end 42 is connected to the downstream end 26 of the powder aspirating duct 8 in a manner allowing fluid flow, said end being of a cross-section of such magnitude that the same partial vacuum shall prevail inside it as in the partial-vacuum chamber 10, whereby said end 26 may be construed being a portion of the partial-vacuum chamber 10.

Preferably the meter 36 shall be a flowmeter generating the measurement signal as a function of the flow of outside air passing through the measurement duct 30. In another embodiment, the meter 36 measures the pressure drop and generates the measurement signal on the signal line 38 as a function of the pressure drop of the outside air flowing through the measurement duct 30. The air pressure in the measurement duct 30 need only be measured at one side downstream of the flow throttle 34 in order to determine the pressure drop, because said measured air pressure need only be related to the outside-air pressure at an atmosphere intake 32. If the cross-section of the measurement duct 30 is capillary or near-capillary, there shall be no need for an additional flow throttle 34. In this latter case a pressure drop can be measured in the same manner in the measurement duct 30 downstream of its atmosphere intake 32 relative to the atmospheric pressure. Operation of the measurement duct 30 only requires that the atmosphere shall communicate in throttled manner with the partial pressure chamber 10 to prevent the atmosphere from disadvantageously affecting or decreasing the partial vacuum in the partial-vacuum chamber 10.

The rate of conveyed powder is substantially dependent on the rate of conveyance air. Another criterion of the invention is the rate of total conveyance air which is moved jointly with the powder through the powder/air duct 2. If this rate of total air is less than the rate of air which is required to move the powder through the powder/air duct 2 without powder deposits taking place, then supplemental air will be required in order to increase the speed of the flow in the powder/air duct 2. When needed, this supplemental air can be fed from the source of compressed air 12 through a supplemental-air line 43 at a supplemental-air intake 46 downstream of the partial-vacuum chamber 10 into the powder/air duct 2. This supplemental air line 43 contains a second variable throttle 44 of which the flow impedance (for instance the flow cross-section) is regulated by an adjustment motor 45 driven by the electronic regulation system 21 as a function of a setpoint value for the volumetric flow of supplemental air which in turn depends on the setpoint value of the powder rate and/or on the setpoint value of the rate of conveyance air.

In an omitted embodiment, the supplemental air can be fed into the partial-vacuum zone 10, 26 to control the partial vacuum.

The partial vacuum in the partial-vacuum chamber 10 is not rigorously constant and will fluctuate even when the rate of conveyance air of the injector nozzle 6 and the rate of supplemental air in the supplemental-air intake 46 and the powder level 48 in the powder container 14 are kept constant. Such uncontrolled fluctuations of the partial vacuum in said partial-vacuum chamber 10 entail undesired fluctuations also in the rate of powder conveyed through the powder/air duct 2.

These fluctuations degrade the measurement results of the measurement duct 30 and hence also the regulation of the feeds of conveyance and supplemental gases. This drawback is palliated by a compensating air intake 56 mounted at the upstream beginning, for instance in the form of a second injection nozzle which is situated axially a slight distance away from the upstream beginning 58 of the powder outlet duct 8 and which blows compensating air axially in the powder aspirating duct 8 through a second partial vacuum chamber in between. The compensating air is fed from the compressed air source 12 through a third variable flow throttle 62 in a compressed air line 64 and through a compensating air duct 66 to the second atomizing nozzle. The powder aspirating duct 8 and the compensating air duct 66 are configured in axially parallel manner in the immersion tube 24 which also receives the second injector nozzle 56 at its lower end. The powder intake of the powder aspirating duct 8 is constituted by one or more powder intake apertures 68 transversely connecting—through the immersion tube 24—the immersion tube outside surface 70 and hence the powder 16 in the powder container 14 with the second partial vacuum chamber 60 of the second injector 72 in order to allow flow. The flow impedance (for instance the flow cross-section) of the third variable throttle 62 may be set permanently or it may be set or regulated manually or automatically or preferably by an adjustment motor 63 driven by the regulation system 21 as a function of other criteria (rates of powder, air conveyance and/or supplemental air).

The regulation system 21 regulates the feed of conveyance air, supplemental air and/or compensating air as a function of the measurement signal of the measurement line 38 and as a function of the setpoint value(s) of the various kinds of compressed air by means of the throttles 18, 44 and 62.

Preferably the powder container 14 is designed in such manner that the powder 16 it contains shall float within an air stream that flows through a perforated container bottom 74 into the container's inside. A much smaller rate of air is introduced from the compensating air intake 56 into the powder flow than from the first injector nozzle 6. The compensation air from the compensating intake 56 when in the second partial vacuum chamber 60 may but need not aspirate powder from the powder container 14. The compensation air is fed through this intake 56 at a lesser, constant rate and as a result stabilizes the above cited pressure fluctuations in the powder aspirating duct 8. The compensation air of the compensation intake 56 raises the frequency of the said fluctuations, i.e. it makes them shorter and quicker, and it reduces their amplitude. As a result the regulator response times of the regulation system 21 attempting to compensate said fluctuations are made substantially shorter. These regulation response times could be empirically shortened to one third.

Preferably the electronic regulation system contains one or more PC's with computer programs in its hardware or software to implement the above described method.

The regulation system 21 comprises an input 80 for the powder setpoint value receiving a manual or automatic fixed or variable setpoint of the powder rate "m" to be conveyed, for instance in g/hr, further an input 81 for the total-air setpoint value receiving a fixed or variable setpoint GV for the total volumetric air passing through the powder/air duct 2 and consisting of the conveyance air in the conveyance line 20, the supplemental air in the supplemental air line 43 and the compensation air in the compensation air line 64, further comprising a high-voltage reference value input 82 receiving a manual or automatic high-voltage value relating to a high voltage electrostatically charging the powder to be sprayed, and where called for a setpoint-value input 83 for the volumetric compensation air AV of the compensation air intake 56. The powder to be sprayed can be electrostatically charged in known manner using electrodes. The rate of the compensation air of the compensation air intake 56 may, but need not, be considered in the operation of the regulation system 21 because being much smaller than the rate of the conveyance air. The compensation air of the compensation air intake 56 may be set at a fixed value or it may be regulated in the manner of the invention using an adjustable throttle 62 driven by the regulation system 21 through its own adjustment motor 63 as a function of other values such as the setpoint "m" and/or one of the air setpoint values.

The rate of conveyance air and of the supplemental air to be conveyed through the conveyance air line 20 and the supplemental air line 43 to the injector when setting a given powder setpoint "m" while observing the setpoint value of the total volumetric flow GV are stored in the regulation system 21 in the form of data or data programs. For elucidation, FIG. 1 also illustratively includes a plot showing that for a given effective setpoint "m" and depending on the predetermined total volumetric setpoint GV, there shall be a given setpoint for the conveyance air FV. The computed differential from the total volumetric air flow GV and the volumetric conveyance air FV is used by the regulation system to ascertain what the setpoint value for the supplemental air in the supplemental air line 43 shall be. Such values will be even more accurate when the regulation system 21 takes into account the compensation air of the compensation air line 64 in the total air flow GV in the manner shown in this illustrative embodiment. As a function of the variable values, the regulation system 21 then generates setpoints in the electrical lines 85, 86 or 87 for the adjustment motors 19, 45 and/or 63. Each variable throttle is fitted with its own adjustment motor.

In the preferred embodiment of the invention, sensors 89, 90 and/or 91 are mounted downstream of the throttles 18, 44 and/or 62 and measure the actual values of the pertinent conveyance air, supplemental air and/or compensation air in the form of pressures, speeds and/or volume and feed a corresponding actual-value signal to the regulation system 21. Depending on its predetermined setpoints and said actual values, the regulation system 21 generates adjustment signals in the electric lines 85, 86 and/or 87 of the adjustment motors 19, 45 and/or 63.

The powder rate is approximately proportional to the rate of conveyance air of the conveyance air line 20. Therefore only the conveyance air need being adjusted to adjust a desired powder rate. Thereupon the regulation system 21 will automatically set the rate of supplemental air by means of the adjustment motor 45 and the throttle 44 in such a way that, in spite of the changed rate of conveyance air, the rate of total air (volumetric flow) shall remain at the setpoint in effect.

At constant air pressure from the source of compressed air 12, the rates of conveyance and supplemental air will only change proportionally in response to a change in the flow cross-section of their throttles 18 and 44, provided their downstream flow impedance be minute. However, as regards apparatus of the present invention comprising an injector and a hooked-up powder line, the flow impedance is large enough that the rates of conveyance air and of supplemental air will not change linearly in response to changes in the flow cross-sections of the throttles 18 and 44. In a preferred embodiment mode of the invention, therefore, the non-linear dependence of at least one, or several, flow impedances (different injectors 4 and/or powder lines) will be stored in the form of plots in such a way that the regulation system 21 shall drive the throttles 18 and 44 in such non-linear manner by means of the adjustment motors 19 and 45 as a function of predetermined setpoints that a change in said setpoints will entail a linear change in the rates of conveyance air and/or supplemental air.

What is claimed is:

1. A spray powder-coating apparatus comprising an injector (4) fitted with a partial-vacuum zone (10) between an injector nozzle (6) and an axially opposite powder/air duct (2) for the purpose of aspirating powder out of a powder source, further comprising a conveyance-air line (20) connected to the injector nozzle in order to feed said nozzle with conveyance air in the form of compressed air, an electronic control system (21) to regulate the conveyance air as a function of a powder setpoint value and of an actual powder value of the rate of conveyed powder, a measurement system (30, 36, 38) connected to the partial-vacuum zone (10) of the injector (4) and feeding a signal of the actual value corresponding to the particular partial vacuum to the regulation system (21), said signal of actual value being interpreted by the regulation system (21) as the rate of conveyed powder, further an adjusting element (18) in the conveyance air line (20) to adjust the conveyance air by means of the regulation system (21) as a function of the powder setpoint value and of the actual value of this powder, characterized in that the adjusting element (18) is a variable throttle (18) of which the flow impedance is adjusted by a motor, in that the throttle (18) is driven by an adjustment motor (19) in turn driven by adjustment signals generated by the regulation signal (21).

2. Spray powder-coating apparatus as claimed in claim 1, characterized in that the supplemental air line (43) is connected to a supplemental-air intake (46) of the injector (4) issuing downstream of the partial-vacuum zone (10) into the powder/air duct (2) to implement the feed of compressed air acting as the supplemental air, in that a variable throttle (44) is mounted in the supplemental-air line (43) and its flow impedance is adjusted by a motor, and in that the throttle (44) is operationally connected to an adjustment motor (45) driven by means of those adjustment signals from the regulation system which are a function of the powder setpoint (m) and of a setpoint value for the rate of total air passing through the powder/air duct (2).

3. Spray powder-coating apparatus as claimed in claim 1, characterized in that a powder-aspirating duct (8) is connected to the partial-vacuum zone (10), in that a compensation-air intake (56) feeding compensation air into the powder aspirating duct (8) to compensate any flow pulsations is connected to the end of the powder aspirating duct (8) which is away from the partial-vacuum zone (10), where the rate of applied compensation air is substantially smaller than the rate of applied conveyance air.

4. Spray powder-coating apparatus as claimed in claim 3, characterized in that a variable throttle (62) exhibiting motor-controlled flow impedance is mounted in the compensation-air line (64) and in that the throttle (62) is operationally connected to an adjustment motor (63) which in turn is driven and regulated by the regulation system (21).

5. Spray powder-coating apparatus as claimed in claim 1, characterized in that a measuring element (89) is mounted in the conveyance-air line (20) downstream from its throttle (18) and generates a signal of actual value as a function of the flow conditions in the conveyance-air line to the control system (21), in that the control system (21) is designed in such manner that it generates the setpoint signals for this throttle (18) also as a function of said signals of actual values of the conveyance air.

6. Spray powder-coating apparatus as claimed in claim 1, characterized in that a measuring element (90) is mounted in the supplemental-air line (43) downstream of its throttle (44) and generates a signal of actual value as a function of the flow condition in the supplemental-air line (43) to the regulating system (21), and in that it also generates the setpoint signals for this throttle (44) as a function of said signals of the actual value of the supplemental air.

* * * * *